US007371118B2

(12) United States Patent
Wu

(10) Patent No.: US 7,371,118 B2
(45) Date of Patent: May 13, 2008

(54) ELECTRICAL CONNECTOR ASSEMBLY WITH REDUCED CROSSTALK AND ELECTROMAGANETIC INTERFERENCE

(75) Inventor: Jerry Wu, Irvine, CA (US)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 11/510,161

(22) Filed: Aug. 25, 2006

(65) Prior Publication Data

US 2008/0050950 A1 Feb. 28, 2008

(51) Int. Cl.
*H01R 9/03* (2006.01)

(52) U.S. Cl. ..... 439/610; 439/660

(58) Field of Classification Search ..... 439/610, 439/660, 701, 493

See application file for complete search history.

(56) References Cited

U.S. PATENT DOCUMENTS 6,217,393 B1 4/2001 Muta
6,276,971 B1 8/2001 Belopolsky
6,488,544 B1 12/2002 Hyland
6,579,127 B2 6/2003 Hess et al.
6,648,668 B1 * 11/2003 Ko ..... 439/353
6,821,151 B2 * 11/2004 Lai ..... 439/610
6,857,904 B2 * 2/2005 Lai ..... 439/610
6,955,568 B1 * 10/2005 Wu ..... 439/660
6,960,089 B2 * 11/2005 Lee et al. ..... 439/79
6,964,587 B2 11/2005 Colantuono et al.
7,074,076 B2 * 7/2006 Richter ..... 439/499

* cited by examiner

*Primary Examiner*—Neil Abrams
*Assistant Examiner*—Phuongchi Nguyen
(74) *Attorney, Agent, or Firm*—Wei Te Chung

(57) ABSTRACT

An electrical connector assembly (100) includes an insulative housing (1), a terminal block assembly (2) assembled to the insulative housing (1) and a cable (3) electrically connecting with the terminal block assembly (2). The insulative housing (1) defines a mating direction and a receiving chamber (15). The terminal block assembly (2) includes a number of first and second terminals (26, 28) and an inserting housing (20) insert-molded with the terminals (26, 28). The first and second terminals (26, 28) are divided into two rows and each having a tail portion (261, 281), an interconnecting portion (262, 282) and a contacting portion (263, 283). The contacting portions (263, 283) of the first terminals (26) and the second terminals (28) extend out of the inserting housing (20) along the mating direction and are located in the same plane.

17 Claims, 8 Drawing Sheets

ELECTRICAL CONNECTOR ASSEMBLY WITH REDUCED CROSSTALK AND ELECTROMAGANETIC INTERFERENCE

CROSS-REFERENCE TO RELATED APPLICATION

This application is related to U.S. patent application Ser. No. 11/481,672, filed on Jul. 5, 2006, and entitled "ELECTRICAL CONNECTOR ASSEMBLY HAVING IMPROVED SHELL", which has the same applicant and assignee as the present invention. The disclosure of related application is incorporated herein by reference.

BACKGROUND OF THE INVENTION

1. Field of the Invention

The present invention relates generally to an electrical connector assembly, and more particularly to an electrical connector assembly for transmitting high-speed signals between two electrical devices.

2. Description of Related Arts

In the days of analog, VGA and S-VGA were the only interfaces required for computer displays. In the last several years, the PC and Consumer Electronics (CE) industries have developed a cornucopia of standards designed to support every type of digital signal that has been developed. Manufacturers have worked very hard to address every type of connection affecting the use of their monitors, TVs, video cards, computers, laptops, etc. This was costly to the manufacturers and consumers alike, and with each new digital standard, rendered another expensive piece of electronic equipment obsolete.

The promulgation of digital standards in the computing and consumer electronics industries, including HDMI, HDTV, and DVI has created a problem for computer monitor and video card manufacturers. The VGA analog interface cannot fully accommodate the rich, multimedia signals that arise from products meeting these standards.

A new Unified Display Interface (UDI) is being designed to be a universal interface to replace VGA interface and remain compatible with HDMI and DVI. A UDI connector comprises a metal shell, an insulative housing received in the metal shell with a plurality of terminals received therein, a plurality of cables respectively electrically connected with the terminals, a PVC housing over-molded to the shell and the cables. However, detailed structures of the UDI connector are not provided, the UDI connector still has room to be improved for achieving perfect signal transmission with compact size.

Hence, an electrical connector assembly is desired to overcome the disadvantage of the related arts.

SUMMARY OF THE INVENTION

Accordingly, the object of the present invention is to provide an electrical connector assembly with reduced cross-talk and electro magnetic interference.

To achieve the above object, an electrical connector assembly in according with the present invention comprises an insulative housing, a terminal block assembly assembled to the insulative housing and a cable electrically connecting with the terminal block assembly. The insulative housing defines a mating direction and a receiving chamber. The terminal block assembly comprises a plurality of first and second terminals and an inserting housing insert-molded with the terminals. The first and second terminals are divided into two rows and each has a tail portion, an interconnecting portion and a contacting portion. The inserting housing is insert-molded with the terminals and comprises a base portion and an inserting portion received in the receiving chamber. The cable comprises a plurality of conductors electrically connecting with the tail portions of the terminals. The inserting housing further defines a plurality of passageways arranged into two rows and interlaced with one another, the tail portions and the interconnecting portions of the first terminals and the second terminals are respectively received in the passageways, the contacting portions of the first terminals and the second terminals extend out of the inserting housing along the mating direction and are located in the same plane.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
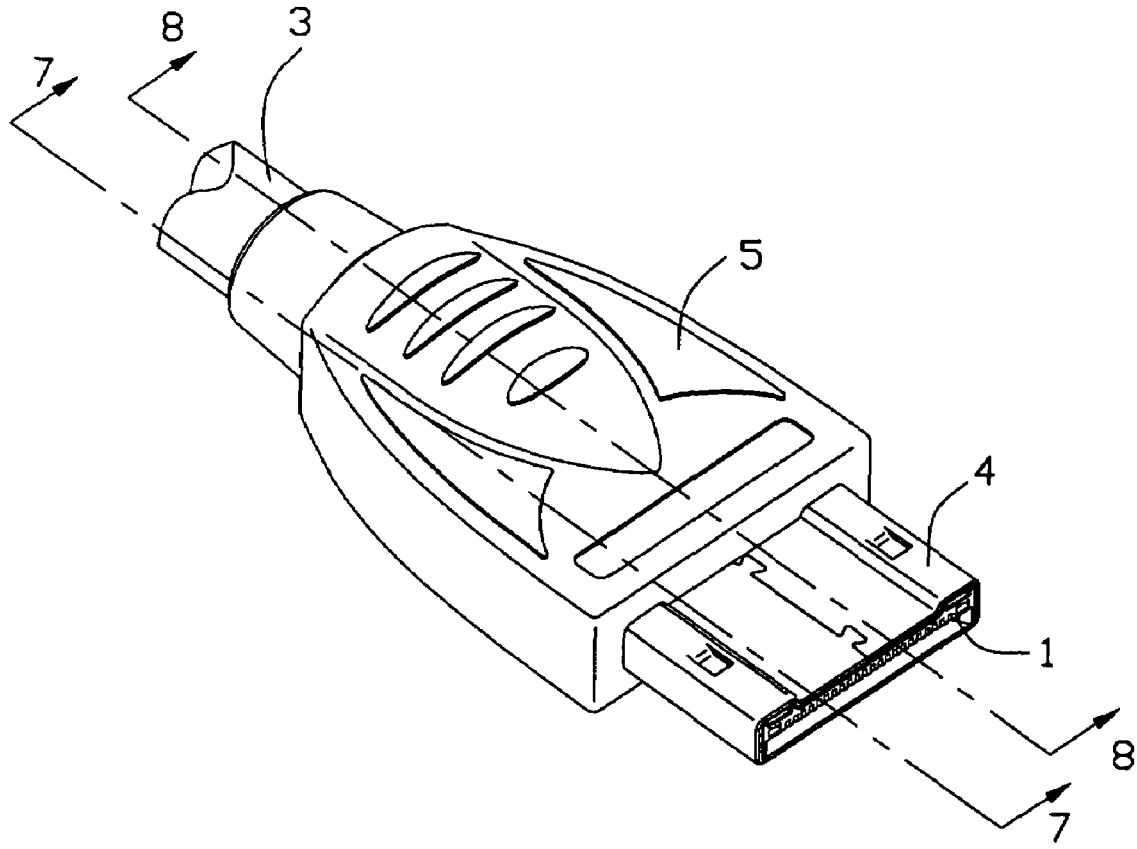
FIG. 1 is an assembled, perspective view of an electrical connector assembly in accordance with the present invention.
Figure 2:
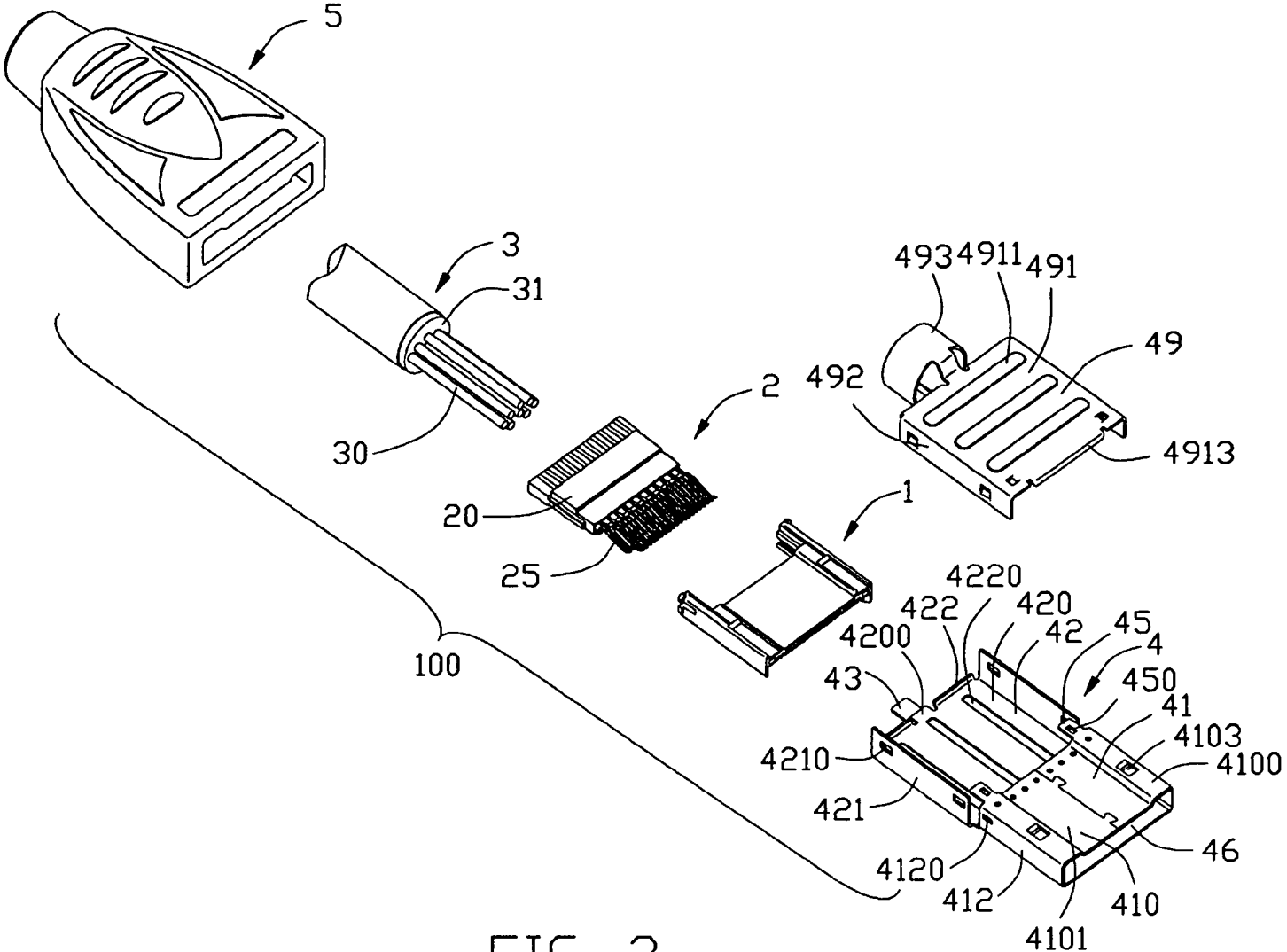
FIG. 2 is an exploded, perspective view of an the electrical connector assembly of FIG. 1.
Figure 3:
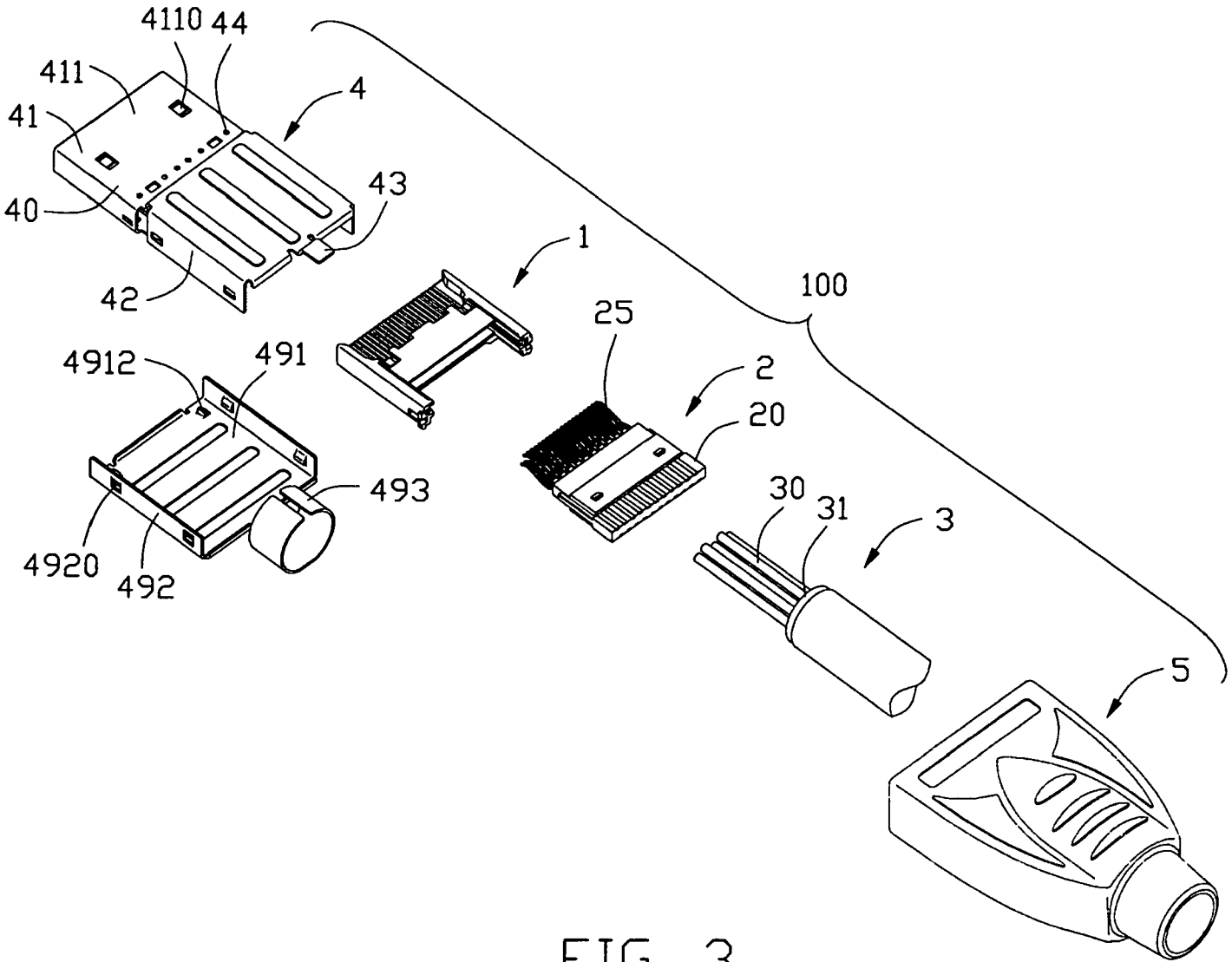
FIG. 3 is a view similar to FIG. 2, but taken from a different aspect.
Figure 4:
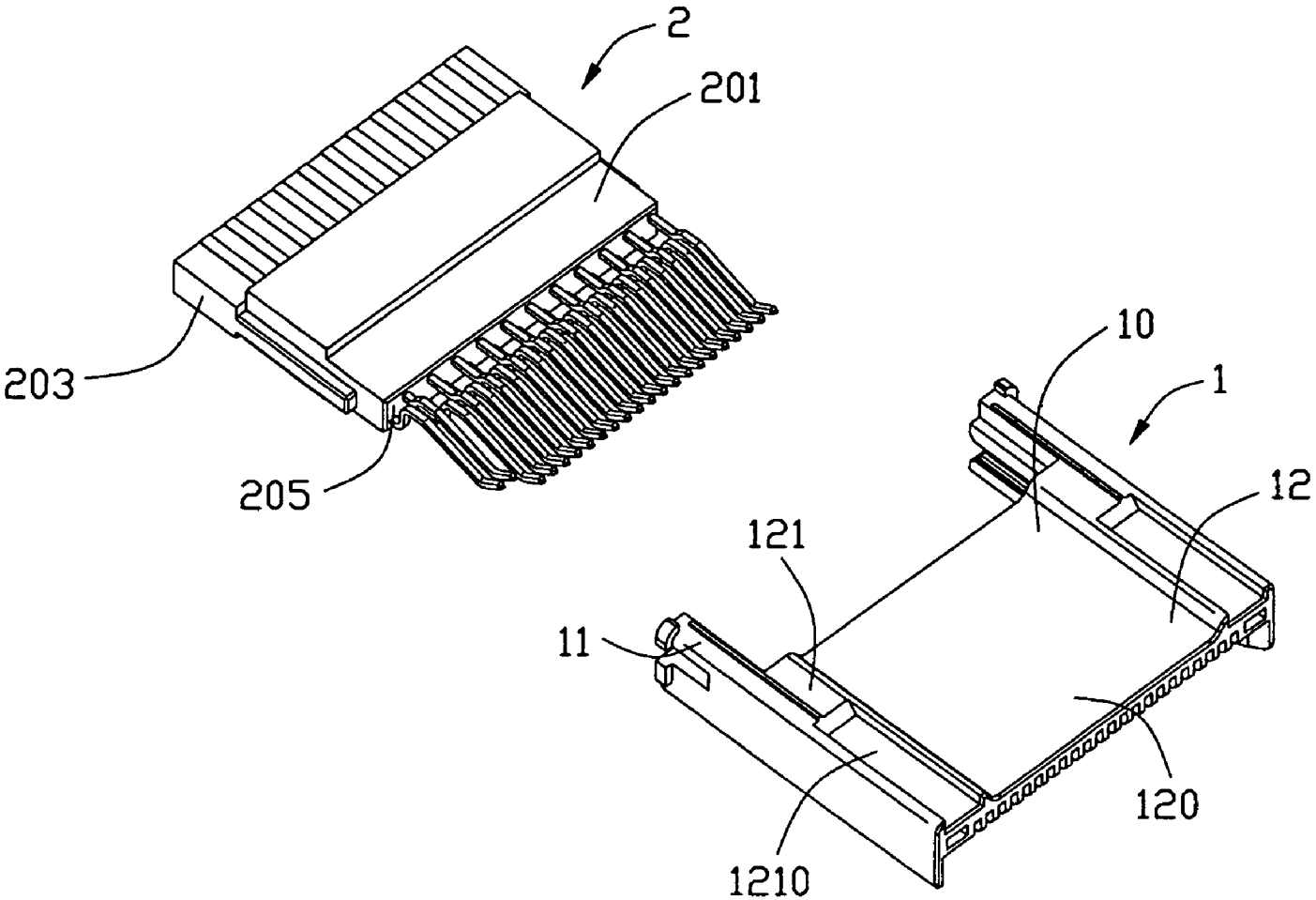
FIG. 4 is an exploded, perspective view of the electrical connector assembly shown in FIG. 1, illustrating a terminal block assembly and an insulatvie housing.
Figure 5:
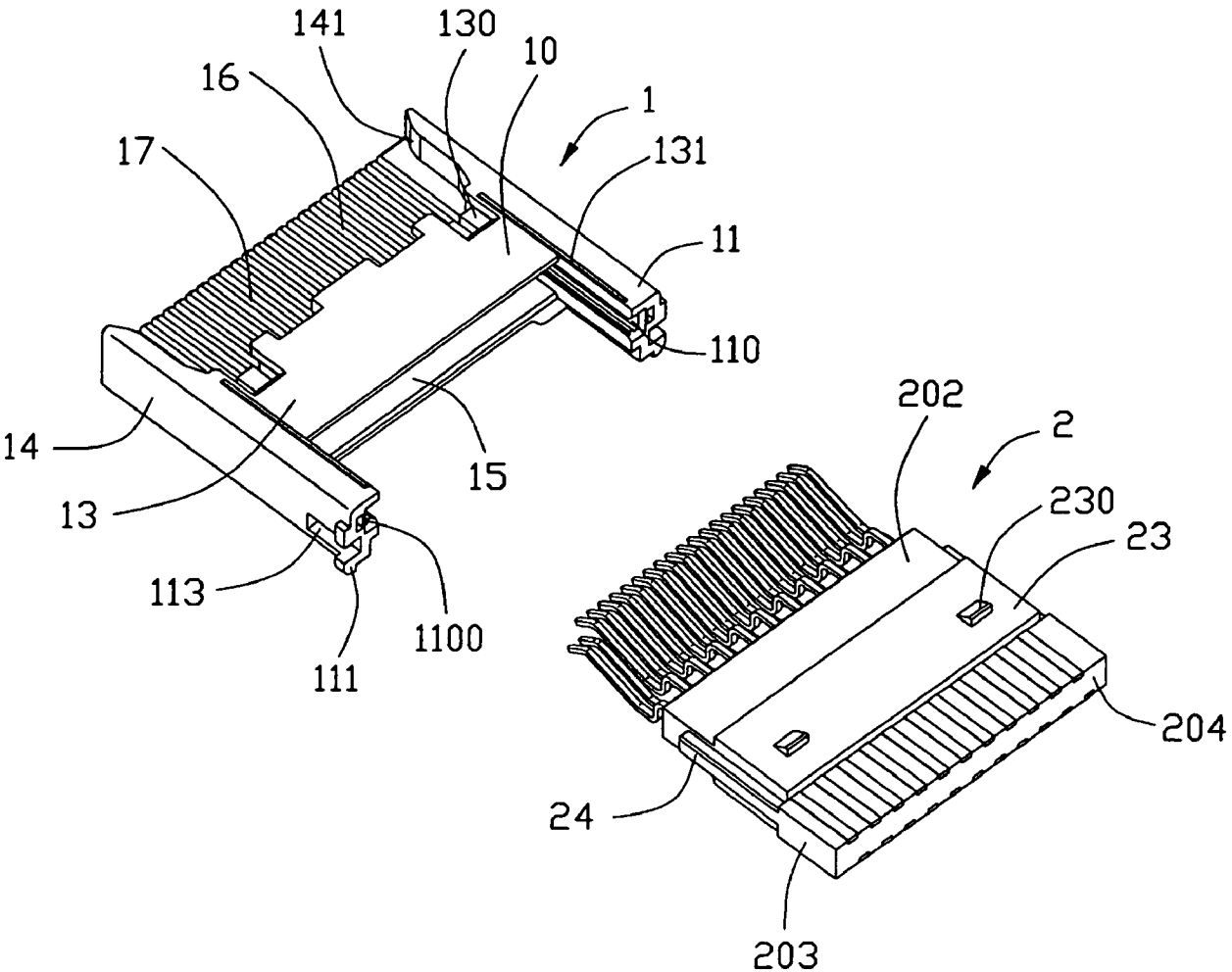
FIG. 5 is a view similar to FIG. 4, but taken from a different aspect.
Figure 6:
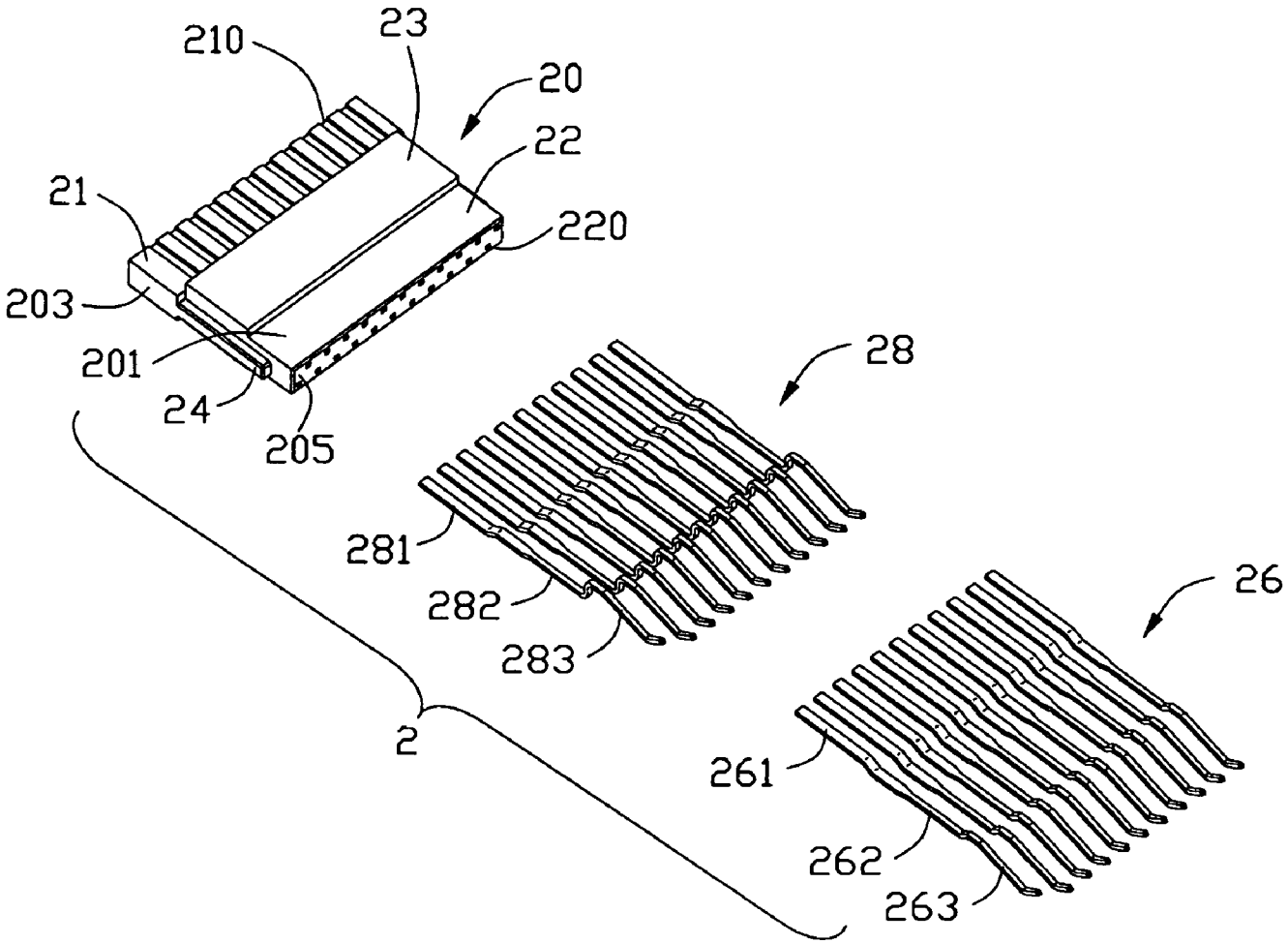
FIG. 6 is an exploded, perspective view of the terminal block assembly of the electrical connector assembly in according with the present invention.
Figure 7:
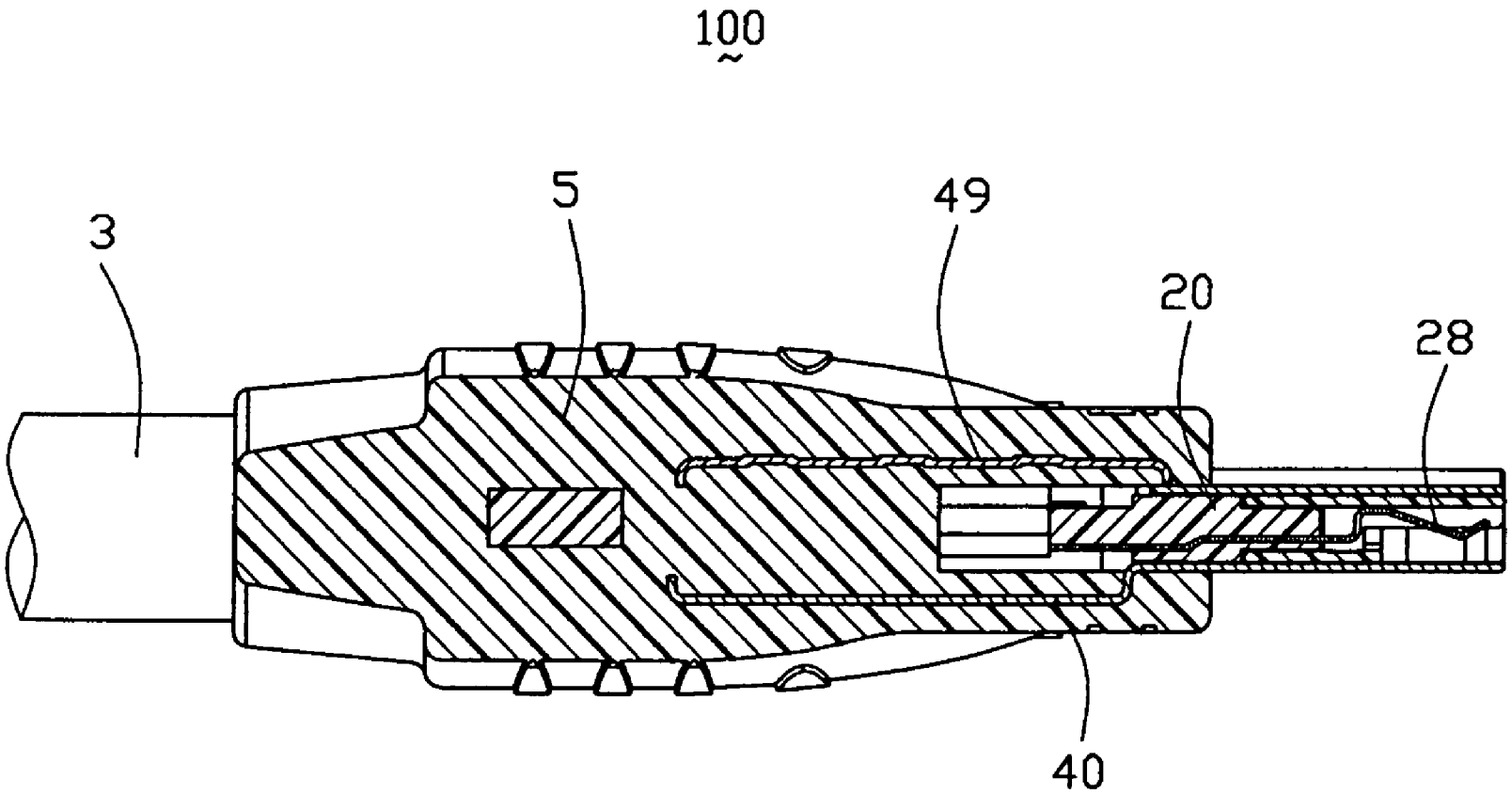
FIG. 7 is a cross-sectional view of FIG. 1 taken along line 7-7.
Figure 8:
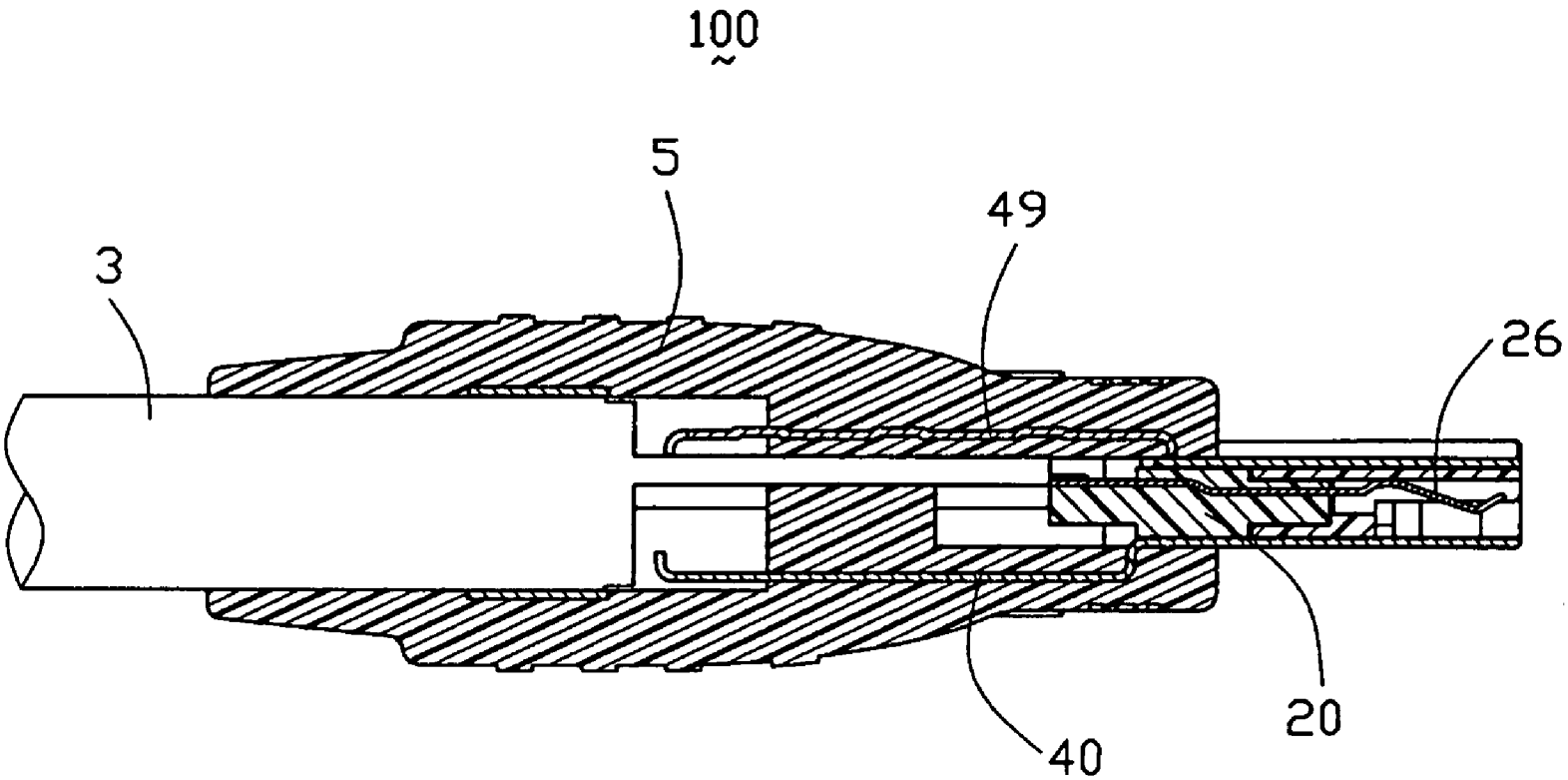
FIG. 8 is a cross-sectional view of FIG. 6 taken along line 8-8.

Referring to FIGS. 1-3, an electrical connector assembly 100 in accordance with the present invention defines a mating direction and a mating interface, and comprises an insulative housing 1, a terminal block assembly 2 attached to the insulative housing 1, a cable 3 electrically connected to the terminal block assembly 2, a metal shell 4 surrounding the insulative housing 1, and a protecting cover 5 partially enclosing the metal shell 4 and the front end of the cable 3.

Referring to FIGS. 2-5, the insulative housing 1 defines a base portion 10, and a pair of connecting portions 11 unitarily formed with and rearwardly extending from the base portion 10 along the mating direction. The insulative housing 1 is formed of an upper wall 12, a lower wall 13 extending parallel to the upper wall 12 and being shorter than the upper wall 12 and a pair of lateral walls 14 extending between the upper and lower walls 12, 13. The upper, lower and lateral walls 12, 13, 14 together define a receiving space (not labeled). In a preferred embodiment, the receiving space is divided into three parts, a receiving chamber 15 defined between inner surfaces of the upper wall 12 and lower wall 13, a plurality of slots 16 slotted in front portion of the upper wall 12 and communicated with the receiving chamber 15 along the mating direction, and a mating space 17 defined by the upper wall 12 and the pair of lateral walls 14, and communicated with the receiving chamber 15 and the slots 16 for receiving a complementary connector (not shown).

The upper wall 12 comprises a pair of lateral portions 121 respectively disposed adjacent to the lateral walls 14, and a generally flat part 120 disposed between the lateral portions 121 and depressed a predetermined distance relative to the lateral portions 121. Each lateral portion 121 comprises a recess 1210 depressed downwardly therefrom and extending rearwardly a given distance from a front surface thereof and stopped at a location adjacent to a rear surface thereof. The lower wall 13 is generally flat, and comprises a pair of notches 130 rearwardly extending a distance from a front surface thereof and disposed at two sides adjacent to the lateral walls 14 respectively, and a pair of ribs 131 formed thereon with a dimension along the mating direction for providing reliable connection when assembled to the metal shell 4. The lower wall 13 further comprises a plurality of cutouts (not shown) for engaging with the complementary connector. Each lateral wall 14 forms an inclined guiding surface 141 by slantwise cutting a front portion thereof for guiding an insertion of the complementary connector. Further, each connecting portion 11 rearwardly extending from two lateral walls 14 of the base portion 10 comprises a guiding slot 110 formed at a lower position of the inner wall thereof and communicating with the chamber 15 for guiding an insertion of the terminal block assembly 2, a securing slit 113 formed at an upper position of the outer wall thereof, and a pair of stoppers 111 disposed at two sides of the securing slit 113 and outwardly extending from the rear edge of the connecting portion 11. In a preferred embodiment, a strengthening rib 1100 is formed in the guiding slot 110 for reliably retaining the terminal block assembly 2 therein. Additionally, one of the pair of stoppers 111 only extends beyond a lateral surface of the connecting portion 11, the other of the pair of the stopper 111 extends beyond the lateral surface and the upper surface of the connecting portion 11, thereby forming a step structure (not labeled) for allowing the metal shell 4 to slide through. Obviously, in a preferred embodiment, the front portion of the base portion 10 with a U-shape cross-sectional view, which comprising the front portion of the upper wall 12 where the slots 16 are formed, the mating space 17 and the front portion of the lateral walls 14, is regarded as the mating interface of the present invention.

Referring to FIGS. 2-8, the terminal block assembly 2 comprises a plurality of terminals 25 and an inserting housing 20 insert-molded with the terminals 25.

The inserting housing 20 is substantially rectangular shaped with a plurality of terminal receiving passageways (not labeled) arranged into two rows and interlaced with one another, and comprises a top wall 201, a bottom wall 202 opposite to the top wall 201, a pair of side walls 203 connecting with the top wall 201 and the bottom wall 202, a rear wall 204 and a front wall 205 opposite to the rear wall 204. The inserting housing 20 is divided into two main parts relative to a base portion 21 and an inserting portion 22 extending forwardly from the base portion 21. The base portion 21 defines a plurality of grooves 210 formed on the opposite sides thereof corresponding to the pitches of terminals 25. The inserting portion 22 defines a plurality of through holes 220 therein respectively communicating with the corresponding grooves 210, a pair of upper and lower platforms 23 respectively projecting outwardly and perpendicular to the top wall 201 and the bottom wall 202 and a pair of guiding rails 24 respectively extending from the two sides thereof and reaching to the same plane of the side walls 203. The lower platform 23 further defines a pair of tapered protrusions 230 locking with the notches 130 for preventing the terminal block assembly 2 from escaping from the insulative housing 1. The through holes 220 are arranged into an upper row of through holes (not labeled) and a lower row of through holes (not labeled) which are respectively aligned with the same terminal pitch along the transversal direction. The upper through holes are interlaced with the lower through holes along the perpendicular direction. The through holes 220 and the grooves 210 together form the terminal receiving passageways.

The terminals 25 comprise a plurality of first terminals 26, and a plurality of second terminals 28 all arranged with predetermined interval. Each first terminal 26 comprises a tail portion 261 for connecting with a cable, an interconnecting portion 262 extending forwardly along the mating direction to form a "Z" shaped configuration together with the tail portion 261 and an "S" shaped contacting portion 263 extending slantwisely and downwardly from the interconnecting portion 262. The second terminals 28 are similar to the first terminals 26 in structure, and each second terminal 28 comprises a tail portion 281 for connecting with a cable, an interconnecting portion 282 extending forwardly along the mating direction to form an inverted "Z" shaped configuration together with the tail portion 281 and an "S" shaped contacting portion 283 extending slantwisely and downwardly from the interconnecting portion 282. The size of the arc end portion (not labeled) of the second terminal 28 is larger than that of the first terminal 26 along the perpendicular direction, therefore, the free ends (not labeled) of the first terminals 26 and the second terminals 28 can reach to the same plane when they are assembled to the corresponding grooves 210 and the through holes 220. Furthermore, the first terminals 26 and the second terminals 28, each comprise a terminal that is shorter than others for achieving the plug-play function.

Referring to FIGS. 1-3, the cable 3 comprises a plurality of conductors 30 for soldering with the terminals 25, an insulator 31 surrounding the conductors 30 for providing a protection, and a grounding layer (not shown) electrically connected with the metal shell 4 for protecting against EMI.

Referring to FIGS. 2-9, the metal shell 4 formed of metal material, comprises a first shell 40, and a second shell 49 assembled with the first shell 40 along a direction perpendicular to the mating direction. However, in a preferred embodiment, the second shell 49 can be assembled to the first shell 40 along the mating direction without departing from the spirit of the present invention.

The first shell 40 comprises a frame-shaped main portion 41, a generally U-shaped extending portion 42 rearwardly extending from the main portion 41, and an reinforcing portion 43 rearwardly extending from middle of a rear edge of the extending portion 42. The main portion 41 comprises a top wall 410, a bottom wall 411 opposite to the top wall 41, and a pair of sidewalls 412 connecting with the top wall 410 and the bottom wall 411. The top, bottom walls 410, 411 and sidewalls 412 together define a receiving cavity 46 for receiving the insulative housing 1 therein. The top wall 410 comprises a pair of lateral protruding portions 4100 disposed in alignment with the lateral portions 121, and a flat portion 4101 depressed a predetermined distance towards the receiving cavity 46 and stepped relative to the lateral protruding portions 4100 and aligned with the flat part 120. Each lateral protruding portion 4100 forms a pair of resilient tabs 4103 bended into the receiving cavity 46 for sliding across the recess 1210 of the lateral portion 121 and preventing the metal shell 4 to be pulled out from the insulative housing 1. The bottom wall 411 comprises a pair of openings 4110 for engaging with the complementary connector. Each sidewall 412 comprises a second resilient tab 4120 formed adjacent to the rear surface thereof and aligned with the securing slit 113 for reliably fixing the insulative housing 1 with the metal shell 4. Both the top wall 410 and the bottom wall 411 all form a plurality of apertures 44 located adjacent to the rear edge thereof.

Additionally, The first shell 40 further comprises a pair of tongue portions 45 respectively extending rearwardly from a rear surface of the lateral protruding portions 4100. Each tongue portion 45 comprises a rectangular aperture 450 disposed in middle thereof. The extending portion 42 with a U-shape cross-sectional view, comprises a lower wall 420 rearwardly extending from the bottom wall 411, a pair of lateral walls 421 opposite to each other and spaced from the lateral walls 412 along the mating direction, and a rear wall 422 with lower height. The lower wall 420, the pair of lateral walls 421 and the rear wall 412 together defines a cavity (not labeled) communicated with the receiving cavity 46. Each lateral wall 421 comprises a pair of rectangular holes 4210. The rear wall 422 defines a cutout 4220 at middle thereof, where the reinforcing portion 43 rearwardly extends therefrom. The lower wall 420 forms a plurality of retentive ribs 4200 extending along the mating direction. Noticeably, the top surface of the rear wall 422 is lower than that of the lateral walls 421.

Referring to FIGS. 2-3, the second shell 49 with a U-shape cross-sectional configuration comprises an upper wall 491, a pair of lateral walls 492 opposite to each other, and a clamping portion 493 extending from the rear side of the upper wall 491. The upper wall 491 and the pair of lateral walls 492 together define a cavity (not labeled) that can enclose the extending portion 42 therein. The upper wall 491 comprises a plurality of retentive ribs 4911 extending along the transversal direction perpendicular to the mating direction, a pair of first latching pieces 4912 punched inwardly towards the cavity and aligned with the apertures 450 for holding the second shell 49 with the first shell 40, and a front curved piece 4913 formed at a front end thereof. Each lateral wall 492 comprises a pair of second latching pieces 4920 inwardly extending towards the cavity for locking with the rectangular holes 4210 of the first shell 40. The clamping portion 493 is bent from a metal sheet to form a circular shaped structure.

Referring to FIGS. 2-3, the protecting cover 5 is molded over rear portions of the housing 1, the metal shell 4 and the terminal block assembly 2 and the conductors 50.

Referring to FIGS. 1-9, in assembly, the first and second terminals 26, 28 are firstly and respectively insert-molded with the inserting housing 20 with the tail portions 261, 281 respectively received in the grooves 210 located upper and lower surface of the base portion 21, the interconnecting portions 262, 282 respectively received in the through holes 220 and the contacting portions 263, 283 extending outwardly from the front wall 205 along the mating direction. The size of the arc portion of the contacting portion 263 of the first terminal 26 is larger than that of the contacting portion 283 of the second terminal 28 along the perpendicular direction, therefore, the free ends of the contacting portion 263, 283 of the first terminals 26 and the second terminals 28 can reach to the same plane despite the terminals 25 are not arranged in the same row. In preferred embodiment according to the present invention, the tail portions 261, 281 of the first terminals 26 and the second terminals 28 are respectively arranged into tow rows to enlarge the pitches of the terminals 25 and further interlaced at intervals. Therefore, these arrangements can effectively reduce the cross-talk and EMI (electro magnetic interference). Next, the terminals block assembly 2 is inserted into, and engaged with the insulative housing 1. During this insertion process, the terminal block assembly 2 is moved toward the insulative housing 1 along the mating direction with the pair of guiding rails 24 respectively moving along the pair of guiding slots 110. The contacting portions 263, 283 of the first terminals 26 and the second terminals 28 pass through the chamber 15 and extend into the mating space to be received in the slots 16. Then, the terminals block assembly 2 will be stopped by the front surface of the base portion 21 since the size of the base portion 21 is larger than that of the guiding slots 110. The tapered protrusions 230 of the platform 23 lock with the notches 130. Additionally, the strengthening ribs 1100 of the guiding slot 110 abut against the guiding rail 24 of the inserting housing 2 for providing an interferential fit therebetween. Therefore, the terminal block assembly 2 is positioned in every direction. Then, the plurality of conductors 30 of the cable 3 are respectively soldered with the tail portions 263, 283 of the first terminals 26 and the second terminals 28.

Referring to FIGS. 1-9, after that, the insulatvie housing 1 with the terminals block assembly 2 is inserted into and assembled with the metal shell 4 along the mating direction. During this assembly process, the insulatvie housing 1 is received in the receiving cavity 46. Further, the pair of lateral portions 121 is putted into the lateral protruding portions 4100 until the stopper portions 111 are obstructed by the rear surface of the main portion 41 of the first shell 40 with the first, second resilient tabs 4103, 4120 are respectively and elastically abutting against the recesses 1210, securing slit 113 for holding the insulative housing 1 in the first shell 40 and preventing the insulative housing 1 from being pulled out. Noticeably, the rear part of the terminal block assembly 2 is located in the cavity defined by the extending portion 42 and the lower wall 422. Then, the grounding layer of the cable 3 lay on the reinforcing portion 43 for supporting the cable 3. Additionally, the ribs 131 of the insulative housing 1 abut against one inner surface of the first shell 40 for providing an interferential fit therebetween. During this insertion process, the tongue portions 45 respectively slide along the lateral portions 121 and locate beyond a rear surface of the connecting portions 11.

Referring to FIGS. 1-9, then, the second shell 49 is assembled to the first shell 40 along the direction perpendicular to the mating direction, with the first and second latching pieces 4912, 4920 respectively being retained in the rectangular holes 4210 and the apertures 450. Thus, the upper wall 491 and the lateral walls 492 of the second shell 49 peripherally enclose the extending portion 42. The clamping portion 493 encloses the reinforcing portion 43 and the grounding layer of the cable 3 together and then solders with the reinforcing portion 43.

Referring to FIGS. 1-9, the protecting cover 6 is molded over rear portions of the housing 1, the metal shell 4, the terminal block assembly 2 and the conductors 30. Since the receiving chamber 15 is substantially filled up by the inserting portion 22 of the inserting housing 20 of the terminal block assembly 2, the contacting portions 263, 283 of the first terminals 26 and the second terminals 28 are free from being contaminated by the melt materials during over molding process of the protecting cover 6.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector assembly, comprising:

an insulative housing defining a based portion, said base portion having an upper wall, a lower wall shorter than the upper wall and a pair of lateral walls connecting the upper wall and the lower wall, the upper wall, the lower wall and the lateral walls together defines a receiving chamber;

a terminal block assembly assembled to the insulative housing, comprising:

a plurality of first and second terminals divided into two rows and each having a tail portion, an interconnecting portion and a contacting portion;

an inserting housing insert-molded with the terminals and comprising a base portion and an inserting portion received in the receiving chamber;

a cable comprising a plurality of conductors electrically connecting with the tail portions of the terminals; and wherein the inserting housing defines a plurality of passageways arranged into two rows and interlaced with one another, the tail portions and the interconnecting portions of the first terminals and the second terminals are respectively received in the passageways, the contacting portions of the first terminals and the second terminals extend out of the inserting housing along the mating direction and are located in the same plane;

a metal shell enclosing the insulative housing, the terminal block assembly and front end of the cable, and comprising a first shell and a second shell coupled to the first shell along a direction perpendicular to the mating direction;

the first shell comprises a frame-shaped main portion, an extending portion rearwardly extending from the main portion and with a U-shape cross-sectional view taken along a direction perpendicular to the mating direction, and an reinforcing portion rearwardly extending from the extending portion.

2. The electrical connector assembly as described in claim 1, wherein the insulative housing defines a mating interface in front hereof with a substantially U-shape cross-sectional view for mating with a complementary connector.

3. The electrical connector assembly as described in claim 1, wherein the upper wall of the insulative housing comprises a pair of lateral portions and a flat portion depressed a predetermined distance relative to the lateral portions and located between the pair of lateral portions.

4. The electrical connector assembly as described in claim 3, wherein the insulative housing further defines a pair of connecting portions unitarily formed with and rearwardly extending from the lateral walls along the mating direction, and each connecting portion comprises a guiding slot formed at a lower position of the inner wall thereof and communicating with the receiving chamber, and wherein the inserting housing forms a pair of guiding rail at two sides of the inserting portion to be capable of sliding along the guiding slots for guiding the inserting housing to the insulative housing.

5. The electrical connector assembly as described in claim 4, wherein the inserting housing comprises a top wall, a bottom wall opposite to the top wall and a pair of side walls, the inserting portion further defines a pair of upper and lower platforms respectively projecting outwardly and perpendicular to the top wall and the bottom wall and a pair of guiding rails respectively extending from the two sides thereof and reaching to the same plane of the side walls.

6. The electrical connector assembly as described in claim 5, wherein the lower platform further defines a pair of tapered protrusions, the lower wall of the insulative housing is generally flat, and comprises a pair of notches rearwardly extending a distance from a front surface thereof and disposed at two sides adjacent to the lateral wall, said pair of tapered protrusions respectively engages with the pair of notches.

7. The electrical connector assembly as described in claim 4, wherein the cable comprises a grounding layer laying on the reinforcing portion for achieving a grounding performance.

8. The electrical connector assembly as described in claim 4, further comprising a protecting cover molded over rear portions of the insulative housing, the terminal block assembly and the metal shell.

9. The electrical connector assembly as described in claim 4, wherein the metal shell comprises a plurality of apertures located adjacent to a rear edge thereof and filled with material of the protecting cover for providing an interference fit when the protecting cover is molded with the metal shell.

10. The electrical connector assembly as described in claim 4, wherein the first shell comprises a pair of lateral protruding portions aligned with the lateral portions of the insulative housing and a flat portion depressed a predetermined distance relative to the lateral protruding portions and located between the pair of lateral protruding portions and aligned with the flat part of the insulative housing.

11. The electrical connector assembly as described in claim 10, wherein each lateral portion of the insulative housing comprises a recess depressed downwardly therefrom and extending rearwardly a given distance from a front surface thereof and stopped at a location adjacent to a rear surface thereof.

12. The electrical connector assembly as described in claim 11, wherein each lateral protruding portion forms a resilient tab inwardly extending therefrom and sliding across the recess during the process of assembly.

13. The electrical connector assembly as described in claim 4, wherein the second shell with a U-shape cross-sectional view comprises an upper wall, a pair of lateral walls opposite to each other which together define a cavity and lock with the extending portion of the first shell.

14. The electrical connector assembly as described in claim 13, wherein the second shell further comprises a clamping portion extending from the rear side of the upper wall and bending from a metal sheet to form a circular shaped structure, said clamping portion encloses the reinforcing portion and the grounding layer together.

15. The electrical connector assembly as described in claim 14, wherein the clamping portion is soldered with the reinforcing portion.

16. An electrical connector comprising:

an insulative housing defining a wall with a plurality of passageways arranged in one row in an inner surface thereof;

a terminal block inserted into the housing and including an insulator with two rows of contacts integrally attached thereto, each of said contacts including a front contacting section forwardly extending beyond a front face of the insulator and disposed in the corresponding passageway, and a tail section extending rearwardly and fully supportably embedded in corresponding groove of the insulator and exposed laterally; and a plurality of wires soldered to the tail sections of the corresponding contacts, respectively; wherein each contacting section extends from the insulator at an upper level and is located in the same plane, while each tail portion extends toward and abuts against a bottom face of each corresponding groove of the insulator;

the insulative housing defines an upper wall, a lower wall extending parallel to the upper wall and being shorter than the upper wall and a pair of lateral walls;

wherein the insulator comprises a top wall, a bottom wall opposite to the top wall and a pair of side walls, the insulator further defines a pair of upper and lower platforms respectively projecting outwardly and perpendicular to the top wall and the bottom wall and a pair of guiding rails respectively extending from the two sides thereof and reaching to the same plane of the side walls.

17. The electrical connector assembly as described in claim 16, wherein the upper wall, the lower wall and the pair of lateral walls together define a receiving space which is divided into three parts, a receiving chamber accommodating the terminal block, a plurality of slots communicating with the receiving chamber and a mating space communicating with the receiving chamber and the slots for receiving a complementary connector.

* * * * *